United States Patent [19]

Kelsall

[11] Patent Number: 4,946,067

[45] Date of Patent: Aug. 7, 1990

[54] INFLATION VALVE WITH ACTUATING LEVER INTERLOCK

[75] Inventor: Gerrard Kelsall, Orange, Calif.

[73] Assignee: Wickes Manufacturing Company, Southfield, Mich.

[21] Appl. No.: 362,781

[22] Filed: Jun. 7, 1989

[51] Int. Cl.[5] ..... B63C 9/24

[52] U.S. Cl. ..... 222/5; 116/200; 222/23; 441/94

[58] Field of Search ..... 222/5, 23, 41, 45, 47–49; 441/89, 92, 93–95; 116/200, 281, 283, 306

[56] References Cited

U.S. PATENT DOCUMENTS

| | | | |
|---|---|---|---|
| 1,772,674 | 8/1930 | Markus | 441/94 |
| 2,036,695 | 4/1936 | Heigis | 222/5 |
| 2,527,604 | 10/1950 | Walk | 441/94 X |
| 2,527,605 | 10/1950 | Walk | 441/94 X |
| 2,675,144 | 4/1954 | Elikann | 222/5 |
| 2,722,342 | 11/1955 | Fox | 222/5 |
| 3,077,288 | 2/1963 | Henry | 222/5 |
| 3,127,624 | 4/1964 | Kubit et al. | 441/95 |
| 3,169,665 | 2/1965 | Colley | 222/5 |
| 3,227,309 | 1/1966 | Segrest | 222/5 X |
| 3,248,010 | 4/1966 | DeBoer | 222/5 |
| 3,630,413 | 12/1971 | Beckes et al. | 222/5 |
| 3,757,371 | 9/1973 | Martin | 222/5 X |
| 4,416,393 | 11/1983 | Zimmerly | 222/5 |
| 4,524,885 | 6/1985 | Zimmerly | 222/5 |
| 4,582,494 | 4/1986 | Becnel | 441/95 |

*Primary Examiner*—Kevin P. Shaver
*Attorney, Agent, or Firm*—David A. Greenlee

[57] ABSTRACT

An inflator according to the present invention comprises a valve body having a replaceable pressure cartridge that is pierced by a piercing pin is operated by an actuating lever to inflate an attached object. The valve body is mounted in a protective housing, and a lanyard carried by the actuating lever extends through an opening in the housing. The lanyard carries an indicia member that emerges from the housing when the handle is pulled to actuate the valve to provide a visible reminder that the cartridge has been discharged and needs replacing. The piercing pin slides in a sleeve slidable in a piercing pin chamber. A spring biases the piercing pin into engagement with the actuating lever. The lever is pivotable from stored to actuated positions to force the pin to pierce the pressure cartridge. An interlock comprising interengageable locking surfaces of the actuator lever and on the pin prevent movement of the lever from actuated position unless the discharged cartridge has been removed. Once the cartridge has been removed, a lockout pin projects into the cartridge chamber to obstruct the insertion of a fresh cartridge until the actuator lever retracts the pin upon return to its stored position. The actuator lever is retained in its stored position by a spring mounted to the actuator lever which releasably engages the housing, and the lanyard is looped through the spring.

17 Claims, 2 Drawing Sheets

20
62
48
50
40
52
18
16
58
38
22
42
47
66
34
46
44
36
28
56
26
106
84
86
90
95
100
98
96
104
26
28
60
66
46
47
28
60
78
76
80
82
86
22
84
72
70
66
88
68
28
106
72
88
68
47
70

INFLATION VALVE WITH ACTUATING LEVER INTERLOCK

BACKGROUND OF THE INVENTION

I. Field of the Present Invention

The present invention relates generally to lever-actuated inflation valves for piercing a pressurized cylinder to inflate an object such as a life vest, and more particularly to an interlock for the actuating lever.

II. Description of the Prior Art

Inflatable devices such as life jackets, rafts and the like include an inflation valve which carries a replaceable pressure cylinder such as $CO_2$ cartridge. Many of these previously known inflation valves include an actuator lever which pivots in response to the pulling of a lanyard or the like in order to drive or permit the forceful release of a piercing pin which penetrates the cartridge. The cartridge is detachably retained adjacent the piercing end of the piercing pin so that it can easily be replaced with a fresh cartridge for subsequent use.

One of the problems of previously known inflation valves is that the actuator lever can often be reset to its stored position after the cartridge has been pierced and discharged. As a result, replacement of the discharged cartridge may be inadvertently overlooked and thus render the device inoperable even when it appears to be prepared for actuation.

Another known problem is that the replacement of the discharged cartridge with a fresh cartridge is not sufficient to insure that the inflation valve is prepared for actuation. In particular, previously known inflation valves permit the replacement of the cartridge without assuring that the actuation lever has been reset. Failure to reset the actuation lever will not permit the fresh cartridge to be punctured by the piercing pin to actuate the device even though a fresh cartridge has been installed.

Another problem of previously known inflation valves is that the actuating lever is relatively small and is shielded by adjacent portions of the valve body. As a result, it may be difficult to determine whether the actuating lever has been moved to actate the device. This problem is further aggravated if the inflation valve and the cartridges are encased in a protective housing. The previously known valve actuator mechanisms do not include any indication of device actuation.

In addition, actuation of prior actuating levers was accompanied by displacement and loss of the device for detentively retaining the lever in stored position. For example, as shown in U.S. Pat. Nos. 4,416,393 and 4,524,885, the lever may be retained in position by a U-shaped clamp having projections engaged within recesses of the body on opposite sides of the lever. A lanyard having a handle at one end and secured at its other end to the end of the actuator lever is pulled and the lever retainer clip is separated from the lever and can be lost when disengaged from the valve body.

Some previously known inflation valves in which the piercing pin is engaged by an actuating lever have included vent passageways communicating between the inflatable chamber and the atmosphere so that environmental pressure changes can be accommodated. For example, partial inflation of a life vest worn by high altitude fliers could interfere with necessary movements by a flier. However, the vents must be closed when the chamber is to be inflated by the pressure cartridge. Accordingly, it has been known to employ surfaces of the actuator lever adjacent the piercing pin engagement surface to position a seal on the piercing pin at a position which seals the vents and prevents leakage of the air passage between the cylinder and the inflatable chamber once penetration has occurred. U.S. Pat. No. 3,248,010 to DeBoer and U.S. Pat. No. 3,169,665 to Cauley disclose vented inflation valves in which the actuation lever cooperates with the pin to position a seal for the vents. However, these patents do not teach that such levers can be reset, and they do not address the problem of premature latching, i.e. latching before the spent cartridge is removed.

SUMMARY OF THE PRESENT INVENTION

The present invention overcomes the above-mentioned disadvantages by providing an inflation valve having a piercing pin assembly which features a lever interlock that locks the actuator lever in an extended, actuated position to prevent its resetting before a discharged pressure cartridge is removed from is retainer in the valve body. In addition, the present invention provides a lockout pin assembly which prevents insertion of a fresh cartridge until the actuator lever has been returned to its stored position. The actuator lever also carries a warning indicator so that movement to its extended position is readily observable. In addition, the lock for retaining the actuator lever in its stored position comprises a spring resiliently urging the actuation lever to its set position within the valve body.

In the preferred embodiment, the piercing pin includes a piercing point at one end and an enlarged piston at its other driving end. The piston engages a surface on the actuator lever including a recess adapted to receive the top of the piston when the lever is in its set position. A cam surface of the actuator lever adjacent the recess is radially graduated from the recess so that the lever increasingly urges the piston and the piercing pin axially along piercing pin chamber in the valve body. The actuating lever also includes a notch adjacent the cam surface and includes a second cam surface adjacent the notched portion.

The piercing pin slides within a sleeve adjacent the threaded retainer for a pressure cartridge within the valve body. A spring is retained between the piston and the seat to urge them apart. As a result, once the actuator lever has been moved to force the piercing pin to pierce the cartridge, the piston is resiliently urged into the notch portion of the actuator lever to lock the lever in its extended, actuated position. The lever cannot be reset to stored position until the cartridge is removed so that the sleeve can be depressed into the area usually occupied by the cartridge. Thus, the present invention provides a means for preventing resetting of the actuator lever once the pin has pierced the cartirdge until the discharged cartridge is removed.

In addition, a lockout pin of the preferred embodiment is slidable within a chamber extending transversely to and in communication with the cartridge retainer chamber. The pin is biased by a spring toward the position at which it extends into the retainer chamber. The lockout pin also engages one end of a lever which pivots on to the valve body so that its other end extends into the path of movement of the actuator lever. As a result, the lockout pin obstructs the retainer chamber and prevents insertion of a cartridge until the actuation lever has moved the control lever to retract the lockout pin from the retainer chamber. Thus, the present invention provides a means for restricting installation of a pressure cartridge until the actuator lever is returned to its stored position.

The actuator lever is retained in stored position by a spring which biases shoulders thereof into a position confined by the valve body. The preferred embodiment provides a spring having free ends engaging lever apertures and axially aligned loops engaging an adjacent pin. An extended shoulder of the spring is confined by the valve body and a locking pin on the valve body. The spring shoulders extend to form a loop or transverse arm through a which a lanyard attached to the actuator lever can be looped. Yanking on the lanyard will dislodge the spring shoulders from their confinement to enable the lever to be moved from its stored position.

The valve body is preferably mounted within a protective housing. The housing has an opening through which the lanyard extends. A warning indicia member secured to the lanyard remains recessed within the housing until the actuator lever is moved to actuated position by pulling the lanyard which pulls the indicia member through the housing opening to provide visible indication that the inflation valve has been actuated. Since the actuator lever is locked in its extended, actuated position, the warning provided by the indicia is maintained until the cartridge is removed, as previously discussed.

Thus, the present invention provides an inflation valve in which the actuator lever cannot be reset until a discharged cartridge has veen removed from the valve body. In addition, a fresh cartridge cannot be installed until the actuator lever has been repositioned in its stored position. A visible indication of valve actuation is provided. Additional objects and advantages of the present invention will be more clearly described in greater detail in the following detailed description.

BRIEF DESCRIPTION OF THE DRAWINGS

The present invention will be more clearly understood by reference to the following detailed description when read in conjunction with the accompanying drawings in which like references characters refer to like parts throughout the views and in which.

DESCRIPTION OF THE PREFERRED EMBODIMENT

Figure 1:
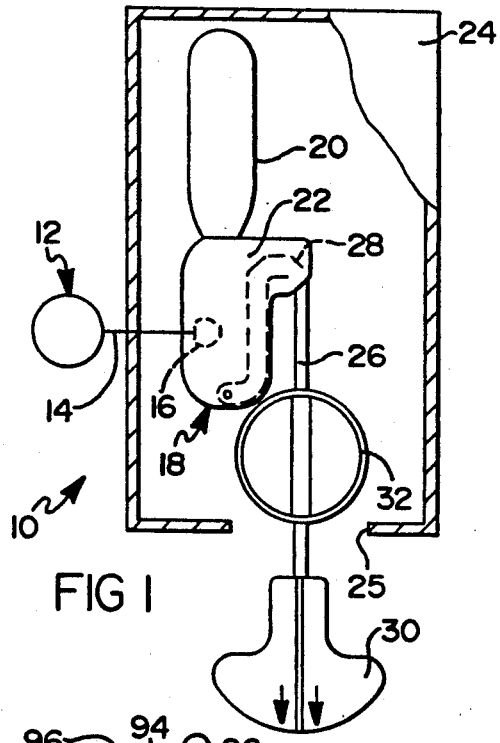
FIG. 1 is a diagrammatic plan view of an inflatable device having an inflation valve constructed in accordance with the present invention.

Referring to FIG. 1, a preferred embodiment of a self inflating apparatus 10 includes an inflatable bladder 12 of a life vest or the like coupled by appropriate passageways 14 to an inflation port 16 of an inflation valve 18. The valve 18 couples a port 16 to a replaceable compressed gas (preferrably $CO_2$) cylinder or cartridge 20. The valve body 22 is mounted within a protective housing 24. A lanyard 26 is coupled to one end of an actuator lever 28 (FIG. 2) shown diagrammatically in its set position in FIG. 1. The lanyard 26 carries a handle 30 at a position exteriorly of the housing 24. The lanyard 26 also carries a warning indicia member 32 confined to a position within a housing 24 when the lever 28 is in its stored, unactuated position.

Figure 2:
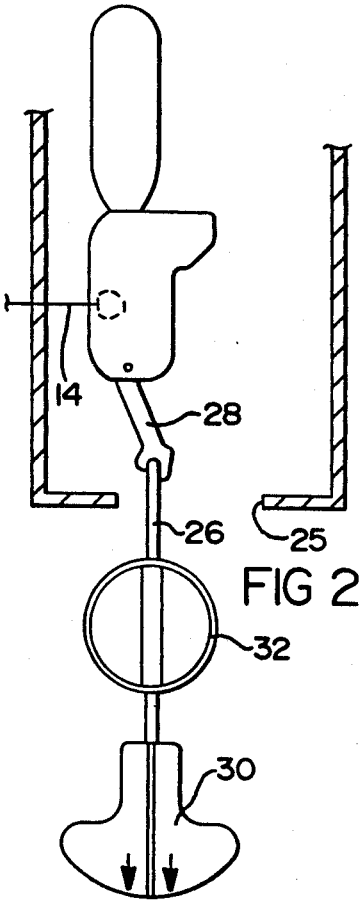
FIG. 2 is a fragmentary, diagrammatic plan view similar to FIG. 1 but showing the inflation valve in an actuated position.
Figure 10:
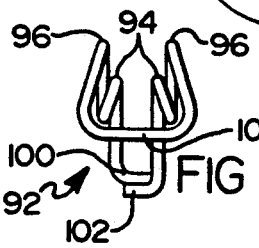
FIG. 10 is a side view of the spring member shown in FIGS. 3, 4, and 9.

As shown in FIG. 2, an opening 25 in housing 24 enables the indicia member 32 to assume a visible external position when the lanyard 26 has been pulled by the handle 30 in the direction of the arrow shown in FIGS. 1 and 2. The actuator lever 28 is maintained in the extended, actuated position shown in FIG. 2, as will be described in greater detail hereinafter. As a result, the indicia member 32 remains in its exposed position externally of housing 24 as a visible indication that the inflation valve 18 has been actuated.

Figures 3, 4, 5, 6, 7:
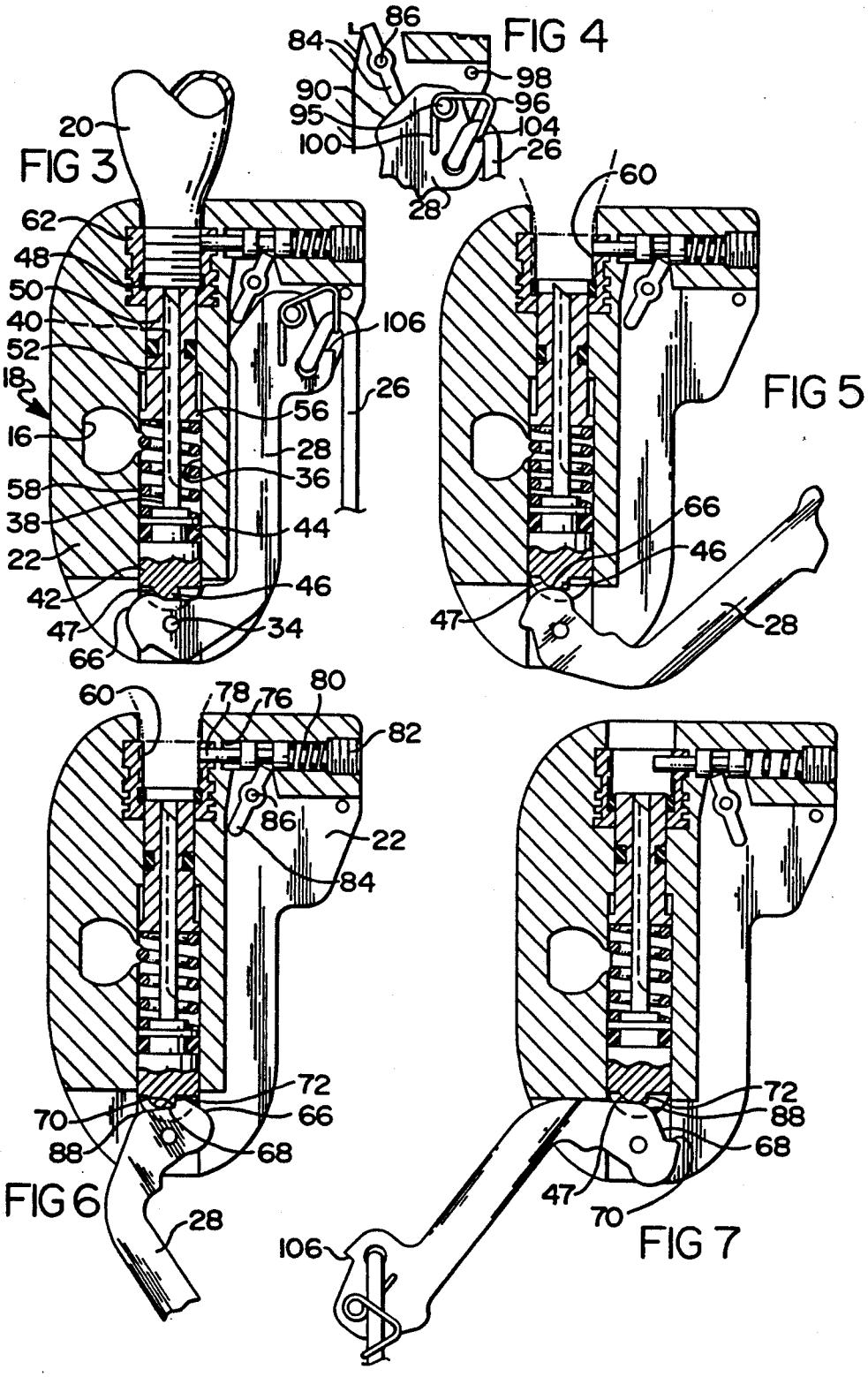
FIG. 3 is an enlarged sectional view of the inflation valve shown in FIGS. 1 and 2 with its actuator lever in a set position.
FIG. 4 is a fragmentary sectional view of a portion of the apparatus shown in FIG. 3 but in a second operational position of the actuation lever.
FIG. 5 is a sectional view similar to FIG. 3 but showing the valve in a further actuation position.
FIG. 6 is a sectional view similar to FIGS. 3 and 5 and showing a further operational position of the components.
FIG. 7 is a sectional view similar to FIGS. 5 and 6 showing a subsequent sequential position of the inflation valve parts.

Referring now to FIG. 3, the actuator lever 28 is pivotally mounted on the valve body 22 by a pivot pin 34 at one end of a valve body chamber 36. A piercing pin 38 is axially aligned in the chamber 36 and includes an axial passage 40 in communication with the chamber 36. The end of the piercing pin 38 nearest pivot pin 34 mounts a piston 42. The piston 42 carries an O-ring seal 44 which engages the peripheral walls of the chamber 36 to prevent leakage of gas from that end of the chamber 36. The piston 42 includes a dome or abutment 46 which is engageable with the actuator lever 28. The dome is contained in a slot 47 which receives the end of lever 28 to prevent rotation of piercing pin 38 in chamber 36.

The other end of the piercing pin 38 is carried within a throughbore 48 of a seat member in the form of a sleeve 50. Sleeve 50 carries an O-ring 52 to seal against the peripheral wall of the chamber 36. This end of the chamber 36 can include a reduced diameter wall portion so that an enlarged flange 56 on the sleeve 50 prevents removal of the sleeve 50. A spring 58 is compressed between the sleeve 50 and the piston 42 to bias these components away from each other.

The chamber 36 communicates with a cartridge retaining chamber 60 (FIG. 5). In the preferred embodiment, the retaining chamber 60 includes an internally threaded insert 62 adapted to engage a correspondingly threaded neck of cartridge 20. The threaded neck of the cartridge 20 engages the end of the sleeve 50 to urge it against the spring 58, thus biasing the dome 46 of piston 42 into engagement with the end of the actuation lever 28.

As shown in FIG. 3, the lever 28 includes a recess 64 receiving dome 46 when the lever is in its stored position. A radially graduated cam surface 66 lies adjacent the recess 64 and engages dome 46 to increasingly displace piston 42 upwardly as the lever is moved from the FIG. 3 position to the FIG. 5 actuating position. This movement of piston 42 upwardly compresses spring 58 and moves piercing pin 38 upwardly to penetrate cartridge 20.

Full extension of lanyard 26 from the opening 25 in the housing 24 displaces actuator lever 28 through slot 47 to the position shown in FIGS. 2 and 6 in which piston dome 46 is spring-biased into lever notch 68 adjacent cam surface 66. In this position, notch surface 70 lockingly engages lever dome surface 72 radially of the pin 34 to prevent the return of lever 28 to the position shown in FIGS. 1 and 3. As a result, the actuator lever 28 is locked in the extended position shown in FIGS. 2 and 6. Consequently, the indicia member 32 remains exposed from the housing 24 as a visible warning that the cartridge has been discharged.

Figure 8:
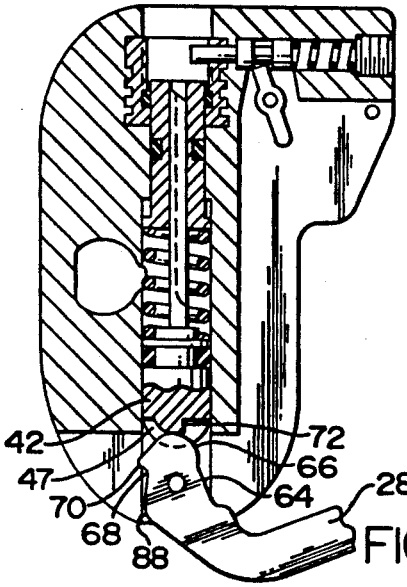
FIG. 8 is a further sectional view showing a further sequential position of the inflation valve shown in FIGS. 5–7.

Referring again to FIG. 6, valve body 22 includes a stepped lockout chamber 76 communicating with the retaining chamber 60. The chamber 76 carries a lockout pin 78 resiliently urged toward chamber 60 by a spring 80 retained by set screw 82 at the end of chamber 76. The pin 78 includes a pair of spaced, enlarged shoulders entraining the end of a control lever 84 therebetween. The control lever 84 is pivoted by a pin 86 to valve body 22 to enable pivotal movement of lever 84 between the positions of FIG. 6 and FIG. 7. The control lever 84 is held in its retracted position shown in FIG. 6 against the force of spring 80 so long as a cartridge 20 is present in the cartridge chamber 60. Conversely, upon removal of the cartridge, as shown in FIG. 7, spring 80 moves lockout pin 78 into chamber 60 to block insertion of a replacement cartridge as shown in FIG. 8. When lever 28 is subsequently returned to stored position, it pivots lever 84 to retract lockout pin 78.

Removal of the cartridge 20 also enables the actuator lever 28 to be reset, as will not be explained with reference to FIGS. 7-9. Once the cartridge 20 has been removed from chamber 60, the sleeve 50 is free to move into the chamber. Further clockwise rotation of lever 28 to the reset position of FIG. 7 causes a second lever cam surface 88 to force piston 42 further into the chamber 36. This movement of piston 42 is unopposed, since spring 58 can now move sleeve 50 into chamber 60. These parts will remain in their fully retracted, lever reset position of FIG. 7 until a new cartridge 20 is inserted.

As shown in FIG. 8, lever 28 can now be pivoted counterclockwise toward its stored position because lever abutment surface 72 clears the now-retracted piston dome 48. Accordingly, lever 28 can be returned to the stored position of FIG. 9. Upon this movement, the distal end 90 of lever 28 contacts (FIG. 4) and rotates control lever 84 to retract lockout pin 78 from within the retaining chamber 60 (FIG. 9). With the lever 28 in its stored position, a fresh replacement cartridge 20 can now be screwed into chamber 60 which forces sleeve 5, spring 58, pin 38, and piston 42 downwardly in chamber 36 from the FIG. 9 position to that shown in FIG. 3. This compresses spring 58 which biases piston 42 outwardly of chamber 36 to force the dome 48 into recess 64 of actuator lever 28.

Figure 9:
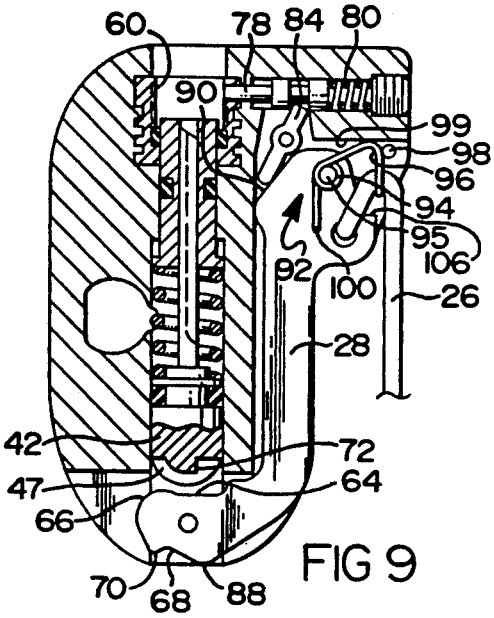
FIG. 9 is a sectional view similar to FIGS. 3–8 showing the inflation valve in position to receive a fresh pneumatic cylinder.

As best shown in FIG. 9, the lever 28 is maintained in its stored position by a spring retainer 92. The spring comprises spaced arms which include coil loops 94 that engage a mounting pin 95 extending through the lever 28. Loops 94 extend to bent shoulders 96 which are biased into confinement between a locking pin 98 and a housing wall 99, since its free ends 100, 102 are confind within mating apertures in the sides of lever 28. The spring arms extend from shoulders 96 and are bent into a transverse arm 104 joining them. The lanyard 26 is preferably looped at 103 over the extension arm 104 so that a pulling force exerted on the lanyard 26 disengages the spring shoulders 96 from entrapment between pin 98 and wall 99. Consequently, the lever 28 can now be pivoted away from its stored position, as shown in FIG. 4 to actuate the inflation valve.

The operation of the device will now be described. With the actuator arm 28 in the FIG. 9 position, cartridge 20 can be installed by screwing its neck into insert 62. This moves sleeve 50 into chamber 36 and compresses spring 58 to urge piston dome 46 in engagement with lever recess 64, as shown in FIG. 3. The valve is now in the FIG. 1 position, with only the handle 30 projecting from housing 24. When it is desired to inflate bladder 12, handle 30 is manually grasped to pull lanyard 26 outwardly from the housing 24, as shown in FIGS. 1 and 2. Initially, lanyard loop 103 pulls spring arm 104 to disengage the elbows 96 from confinement between locking pin 98 and housing wall 99. This releases actuator lever 28 for displacement from its stored position of FIG. 4. Movement of spring arm 104 is limited by engagement with a shoulder 106 formed on the end of lever 28.

As the lever 28 pivots through the FIG. 5 position, cam surface 66 depresses piston 42 which compresses spring 58 that drives piercing pin 38 through the end of the cartridge 20 to enable the discharge of pressure cartridge 20 through pin passageway 40 into chamber 36, out port 16, and through passageways 14 to inflate bladder 12.

When lever 28 reaches the extended position of FIGS. 2 and 6, piston dome 46 engages lever notch 68 under the bias of spring 58. As a result, the lever 28 is locked against movement toward its stored position by interengagement of surfaces 70 and 72. Accordingly, the lever 28 cannot be reset until cartridge 20 is removed. Moreover, the indicia member 32 remains externally of the housing 24 as a visible reminder that cartridge 20 has been discharged.

When the cartridge is removed, as shown in FIG. 7, the lever can be pivoted further clockwise to force piston 42, the spring 58, and the sleeve 50 further within chamber 36 to enable lever 28 to be pivoted in a reverse direction toward its stored position, as shown in FIG. 8. With cartridge 20 removed, spring 80 projects lockout pin 78 into chamber 60 to prevent insertion of a fresh cartridge 20. However, further movement of lever 28 to its stored position of FIG. 9 retracts the lockout pin 78 to enable installment of a new cartridge. In this manner the interlock mechanism prevents installation of a new cartridge until lever 28 is reset.

Having thus described the present invention, many modifications thereto will become apparent to those skilled in the art to which it pertains without departing from the scope and spirit of the present invention as defined in the appended claims.

What is claimed is:

1. An inflation valve actuator comprising a body having a cartridge chamber for receiving a replaceable pressure cartridge;

a connected piercing pin chamber extending to the body exterior;

a cartridge piercing pin slidable in the pin chamber between extended and retracted positions and having a piercing end and a remote abutment end;

a sleeve slidable on the pin within the pin chamber adjacent the cartridge chamber and movable between a retracted position in the cartridge chamber and an extended position in the pin chamber;

biasing means biasing the pin and the sleeve to retracted positions; and an actuating lever pivotally mounted to the housing adjacent the pin chamber for movement between stored, actuating, actuated and reset positions, the lever including an operating portion on end end having a recess for receiving the pin abutment in stored position, an adjacent first cam surface for engagement with the pin abutment in lever actuating position to move the pin to retracted position to pierce the cartridge, an adjacent locking surface for engagement with the pin abutment in lever actuated position to prevent movement of the lever toward stored position, and an adjacent second cam surface for engagement with the pin abutment to move the pin and sleeve to retracted positions in lever reset position to enable subsequent movement of the lever to tored position.

2. The invention of claim 1 further comprising a piston secured to the pin at the abutment end.

3. The invention of claim 1 wherein the pin chamber is defined by a peripheral wall and further comprising a seal carried by the sleeve and engaging the peripheral wall.

4. The invention of claim 1 further comprising a housing enclosing the body and the actuator lever, and indicating means for externally indicating that the actuator lever has been moved to actuated position.

5. The invention of claim 4 wherein the housing includes an opening and the indicating means comprises an indicia member connected to the other end of the actuator lever, whereby movement of the lever to actuated position discharges the indicia member through the opening.

6. The invention of claim 1 further comprising a retainer for retaining the actuator lever in its stored position.

7. The invention of claim 6 wherein the retainer comprises a spring mounted on the lever and having a shoulder engaging a stop member secured to the body.

8. The invention of claim 7 wherein the other end of the actuator lever is attached to a lanyard mounting the indicia members and the spring includes a free end engaged by an intermediate portion of the lanyard.

9. In combination with an inflation valve comprising a body having a replaceable pressure cartridge, a piercing pin mounted for sliding movement toward the cartridge, an actuator lever pivotally mounted on the housing, a spring biasing the pin into engagement with the actuator lever, the actuator lever having a first cam surface portion for moving the pin to pierce the cartridge upon movement of the lever from stored to actuated position, the improvement comprising:

interengageable locking means on the pin and on the actuating lever for restricting return movement of the lever to stored position, and lock release means for enabling such return movement when the cartridge has been removed.

10. The invention of claim 9 wherein the lock release means comprises a pin seat member movable to release the spring bias on the pin to enable disengagement of the locking means.

11. In combination with an inflation valve comprising a body with a replaceable pressure cartridge; a piercing pin mounted for sliding movement toward the cartridge, an actuator lever engageable with the pin abd pivotally mounted at one end to the housing for movement from a stored position to an actuated position to force the piercing pin to penetrate the pressure cartridge; and actuating means connected to the other end o the lever for actuating the lever, the improvement comprising:

a housing containing the valve actuator and having an opening therein; and an indicator attached to the actuating means which is moved through the housing opening upon lever actuation to provide visible indication of valve actuation.

12. In combination with an inflation valve comprising a body with a replaceable pressure cartridge; a piercing pin mounted for sliding movement toward the cartridge, an ctuator lever pivotally mounted to the housing for movement between a stored position and an actuated position to move the piercing pin to pierce the pressure cartridge; the improvement comprising:

means for preventing movement of the actuator lever from actuated position to stored position until the penetrated cartridge is removed.

13. The invention of claim 12 further comprising means for preventing insertion of a new cartridge until the actuator lever has been moved to its stored position.

14. In combination with an inflation valve comprising a body having a replaceable pressure cartridge in a cartridge chamber; a piercing pin mounted for sliding movement toward the cartirdge; an actuator lever pivotally mounted to the housing for movement between a stored position and an actuated position to move the piercing pin to pierce the pressure cartidge; the improvement comprising:

lockout means for preventing installation of a replacement pressure cartridge until the actuator lever has been moved to its stored position.

15. The invention of claim 14 wherein the lockout means comprises a lockout pin, a body chamber communicating with the cartridge chamber adapted to receive the lockout pin, a spring biasing the pin toward the cartridge chamber, and a control lever pivotally mounted to the body with one end engaging the lockout pin and its other end engageable by the actuator lever upon movement to its stored position to retract the lockout pin from the cartridge chamber to enable replacement of the cartridge.

16. In combination with an inflation valve comprising a body having a replaceable pressure cartridge; a piercing pin mounted for sliding movement to pierce the cartridge; an actuator lever pivotally mounted to the housing; a spring biasing the pin into engagement with the actuator lever, the actuator lever having a cam surface for displacing the pin to pierce the cartridge upon movement of the actuator lever from stored to actuated positions, the improvement comprising:

a spring mounted on the actuator lever to engage the body to retain the actuator lever in its stored position.

17. The invention of claim 16 further including a lanyard attached to the lever and operable to move the spring to release the lever.

* * * * *